US012480506B1

(12) United States Patent
Zhan

(10) Patent No.: US 12,480,506 B1
(45) Date of Patent: Nov. 25, 2025

(54) HANDHELD FAN

(71) Applicant: Shenzhen Zhianyi Technology Co., Ltd., Guangdong (CN)

(72) Inventor: Angli Zhan, Guangdong (CN)

( * ) Notice: Subject to any disclaimer, the term of this patent is extended or adjusted under 35 U.S.C. 154(b) by 0 days.

(21) Appl. No.: 18/974,613

(22) Filed: Dec. 9, 2024

(30) Foreign Application Priority Data

Aug. 27, 2024 (CN) ..... 202422077922.4

(51) Int. Cl.
*F04D 25/06* (2006.01)
*F04D 25/08* (2006.01)

(52) U.S. Cl.
CPC ..... *F04D 25/084* (2013.01); *F04D 25/0673* (2013.01)

(58) Field of Classification Search
CPC .... F04D 25/084; F04D 25/0673; F04D 25/08; F04D 25/166; F04D 19/002; F04D 29/703; F04D 29/4226
See application file for complete search history.

(56) References Cited

U.S. PATENT DOCUMENTS

| | | | | |
|---|---|---|---|---|
| 11,543,093 | B2 * | 1/2023 | Puzio | F21V 23/0442 |
| 2021/0310718 | A1 * | 10/2021 | Zeng | F25D 7/00 |
| 2023/0265854 | A1 * | 8/2023 | Chen | F04D 19/002 416/63 |
| 2024/0369242 | A1 * | 11/2024 | Choi | F04D 25/084 |

* cited by examiner

*Primary Examiner* — Dapinder Singh

(57) ABSTRACT

A handheld fan, comprising an air supply part and a handheld part, wherein the air supply part comprises a fan housing and a fan assembly arranged in the fan housing; the fan housing comprises a cover body, an air outlet accessory arranged at a front end of the cover body, a rear air inlet accessory arranged at a rear end of the cover body, and side air inlet accessories arranged at both sides of the cover body; the fan assembly is mounted in the cover body, and its air outlet is connected to the air outlet accessory. The invention has a reasonable structure, beautiful shape, high ornamental value, compact structure, easy operation, and multi-faceted air inlet, which provides sufficient air volume for the high-speed running fan, so that the handheld fan maintains high-performance operation and improves the user experience.

7 Claims, 8 Drawing Sheets

HANDHELD FAN

TECHNICAL FIELD

The invention relates to the technical field of handheld fans, and in particular to a handheld fan.

BACKGROUND ART

A fan is an electrical appliance that uses an electric motor to drive the blades to rotate to accelerate the circulation of air. Fans are mainly used for cooling down and circulating air. Currently, in handheld fan technology, the poor compactness of the handheld fan structure and the poor performance reliability cannot be achieved at the same time. For example, in order to achieve compactness, the overall structure becomes compact, resulting in the air intake volume not meeting the performance requirements, and the high-speed fan cannot obtain sufficient air intake.

Therefore, it is necessary to provide a new technical solution to solve the above technical problems.

SUMMARY OF THE INVENTION

The technical problem to be solved by the invention is to overcome the defects of the above technology and provide a handheld fan.

A handheld fan, comprising an air supply part and a handheld part, wherein the air supply part comprises a fan housing and a fan assembly arranged in the fan housing; the fan housing comprises a cover body, an air outlet accessory arranged at a front end of the cover body, a rear air inlet accessory arranged at a rear end of the cover body, and side air inlet accessories arranged at both sides of the cover body; the fan assembly is mounted in the cover body, and its air outlet is connected to the air outlet accessory;

the handheld part comprises a handheld housing and a battery arranged in the handheld housing and used to supply power to the fan assembly; the handheld housing comprises a front housing body and a rear housing body which are buckled into each other; a top end of the front housing body is connected to the cover body as a whole, and an inner cavity formed by the front housing body and the rear housing body is connected to the cover body.

Further, the air outlet accessory is provided with a plurality of air outlet guide plates corresponding to the air outlet of the fan assembly;

the air outlet accessory and the rear air inlet accessory are both connected to the cover body via buckles and clamping slots;

an end of the rear air inlet accessory away from the cover body is provided with a curved panel for guiding air flow, and an air inlet gap is provided around the curved panel;

side air inlets are provided on both sides of the cover body; the side air inlets are connected to a mounting plate via a plurality of evenly distributed connecting rods, and the mounting plate is connected to a side air inlet accessory via inserting slots and inserting holes; a side of the side air inlet accessory away from the cover body is arranged in the form of a guide curved surface;

a limiting plate for placing the fan assembly is provided on an inner side of the rear air inlet accessory and an inner side of the cover body;

the front housing body and the rear housing body of the handheld housing are butt-jointed via a clamping plate with a clamping hole and a clamping block.

Further, it is further provided with a control system, which comprises a control main board arranged inside the handheld housing and above the battery; the control main board is electrically connected to a control switch key and a charging connector for charging the battery; the handheld housing is provided with a clearance hole for the control switch key and the charging connector; the fan assembly is electrically connected to the battery and the control main board.

Further, the control main board is further connected to a display.

Further, the display is mounted at a top of the front housing body and is provided with a transparent protective shell.

Further, the display is mounted on the air outlet accessory and is provided with a transparent protective shell.

Further, the air intake mode of the fan assembly is side intake.

Further, a bottom end of the front housing body is provided with a bottom plate, and an upper side of the bottom plate is provided with a guide plate; a bottom end of the rear housing body is provided with a guide rod, and the guide rod is inserted into the front housing body along the guide plate; the bottom plate and the guide rod are fixedly connected via screws.

The advantages of the invention are: the invention has a reasonable structure, beautiful shape, high ornamental value, compact structure, easy operation, and multi-faceted air inlet, which provides sufficient air volume for the high-speed running fan, so that the handheld fan maintains high-performance operation and improves the user experience.

A display device is added to the handheld fan, which can be used to display the power, fan speed, etc., which is more intuitive.

The fan housing and handheld housing are modularly configured to facilitate large-scale production, and the corresponding components are connected in buckle to facilitate quick assembly and improve production efficiency.

Figure 1:
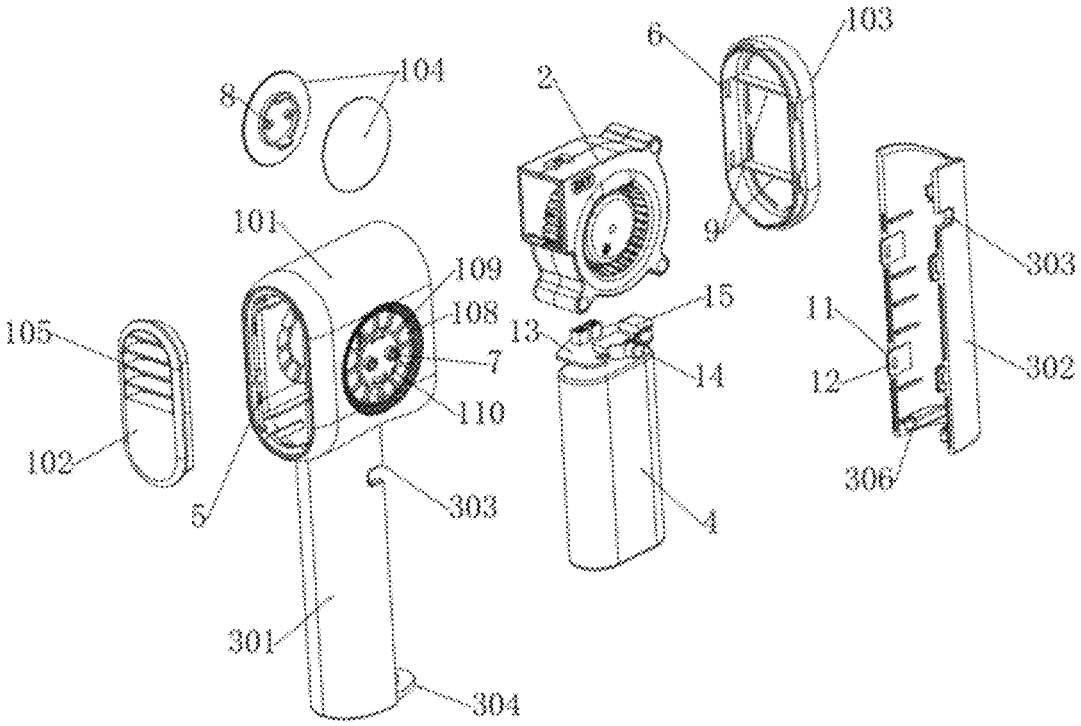
FIG. 1 is a first schematic diagram of an exploded perspective view of Embodiment 1 of the handheld fan according to the invention.

As shown in the figures: 1 refers to the fan housing; 2 refers to the fan assembly; 3 refers to the handheld housing; 4 refers to the battery; 5 refers to the buckle;

6 refers to the clamping slot; 7 refers to the inserting slot; 8 refers to the inserting hole; 9 refers to the limiting plate; 10 refers to the clamping block; 11 refers to the clamping plate; 12 refers to the clamping hole; 13 refers to the control main board; 14 refers to the control switch key; 15 refers to the charging connector; 16 refers to the display; 17 refers to the transparent protective shell; 101 refers to the cover body; 102 refers to the air outlet accessory; 103 refers to the rear air inlet accessory; 104 refers to the side air inlet accessory; 105 refers to the air outlet guide plate; 106 refers to the curved panel; 107 refers to the air inlet gap; 108 refers to the side air inlet; 109 refers to the connecting rod; 110 refers to the mounting plate; 301 refers to the front housing body; 302 refers to the rear housing body; 303 refers to the clearance hole; 304 refers to the bottom plate; 305 refers to the guide plate; 306 refers to the guide rod.

SPECIFIC EMBODIMENT OF THE INVENTION

In the description of the invention, it should be understood that the orientation or positional relationship indicated by the terms "center", "longitudinal", "transverse", "length", "width", "thickness", "upper", "lower", "front", "back", "left", "right", "vertical", "horizontal", "top", "bottom", "inner", "outer", "clockwise", "counterclockwise" etc. are based on the orientation or positional relationship shown in the drawings, and is only for the convenience of describing the invention and simplifying the description, but not indicate or imply that the pointed device or element must have a specific orientation, be constructed and operated in a specific orientation, and therefore cannot be understood as a limitation of the invention.

In addition, the terms "first" and "second" are only used for descriptive purposes, and cannot be understood as indicating or implying relative importance or implicitly indicating the number of indicated technical features. Thus, the features defined with "first" and "second" may explicitly or implicitly include one or more of these features. In the description of the invention, unless otherwise clearly defined, "plurality" means two or more.

In the invention, unless otherwise clearly defined and limited, the terms "installed", "connected", "fixed" and other terms should be interpreted broadly; for example, it can be a fixed connection, a detachable connection or an integral connection; it can be a mechanical connection or an electrical connection; it can be a direct connection or an indirect connection through an intermediary, and it can be a connection between two components. For those of ordinary skill in the art, the specific meanings of the above terms in the invention can be understood according to specific circumstances.

In the description of the embodiments of the invention, if "several" is involved, it means more than one; if "multiple" is involved, it means more than two; if "greater than", "less than" or "exceed" is involved, it should be understood as not including the number itself; if "above", "below" or "within" is involved, it should be understood as including the number itself. If "first" or "second" is involved, it should be understood as being used to distinguish technical features, and should not be understood as indicating or implying relative importance or implicitly indicating the number of the indicated technical features or implicitly indicating the order of the indicated technical features.

The invention will be further described in detail hereinafter with reference to the drawings.

EMBODIMENT 1

Figure 2:
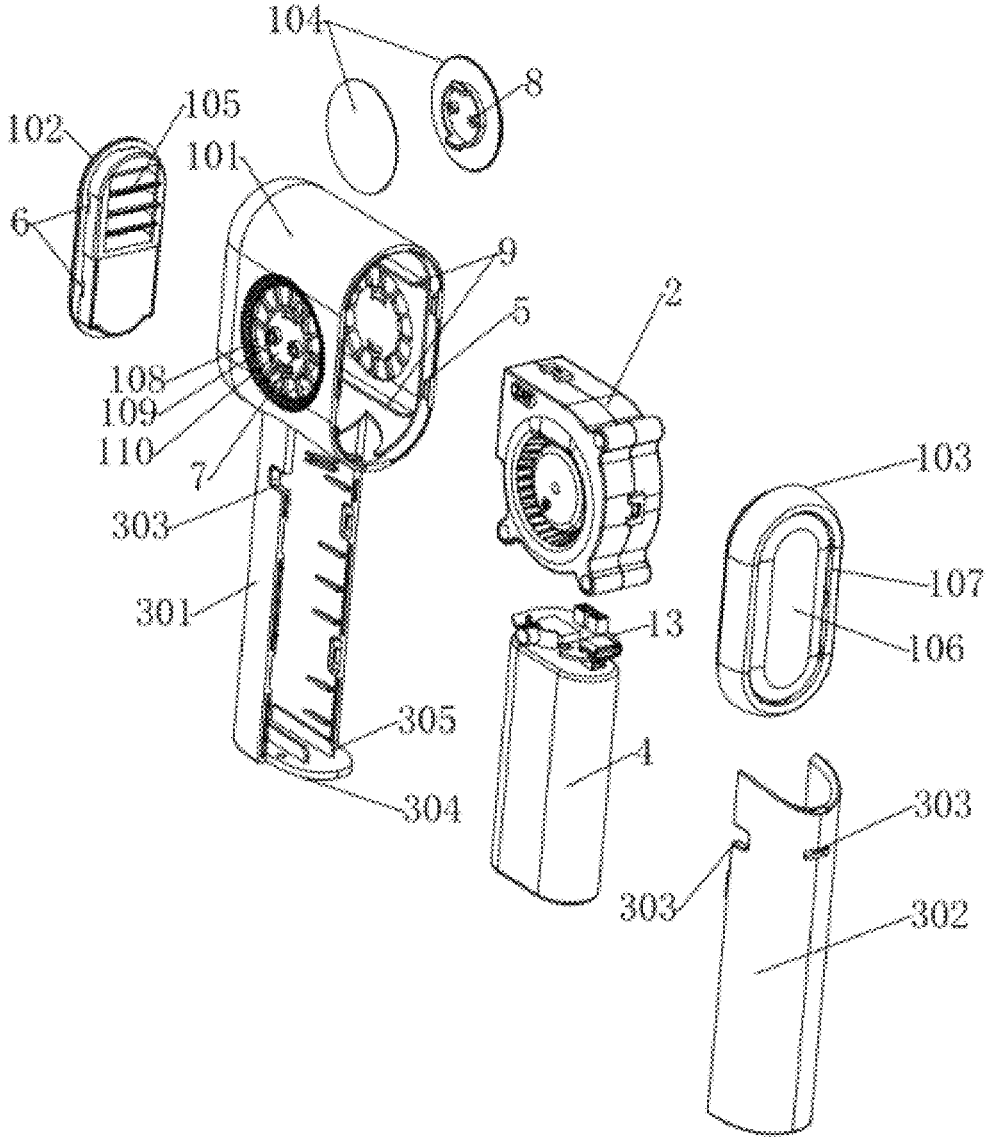
FIG. 2 is a second schematic diagram of an exploded perspective view of Embodiment 1 of the handheld fan according to the invention.
Figure 3:
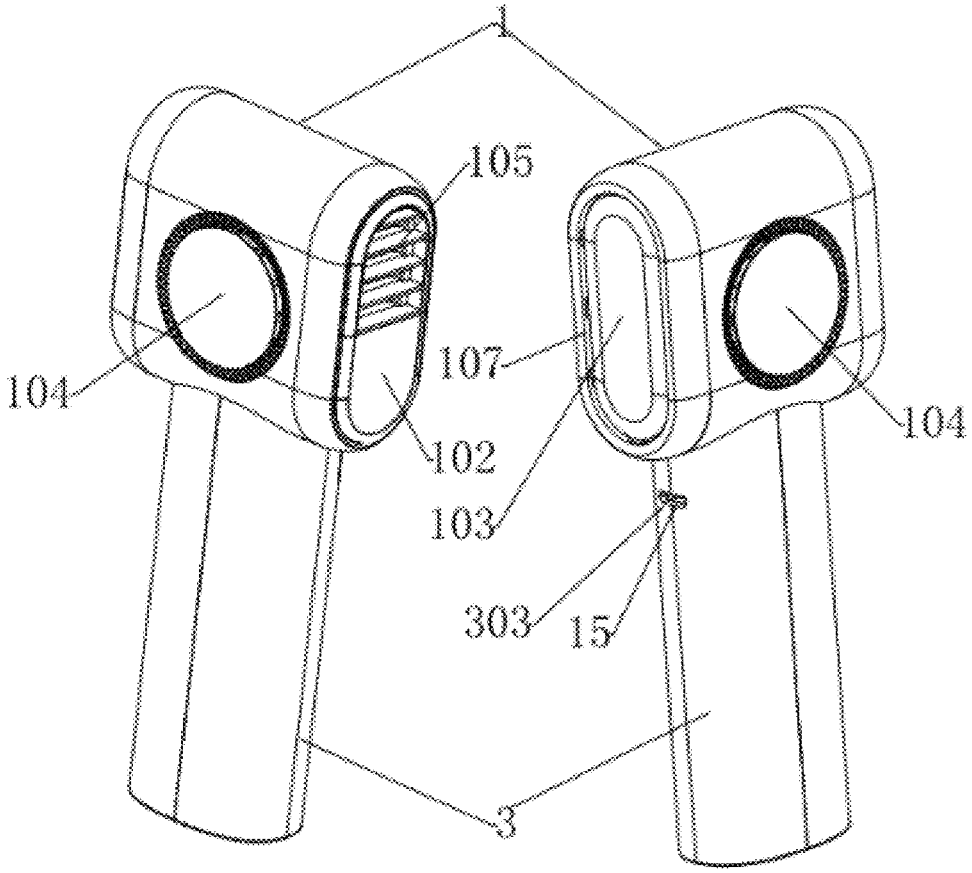
FIG. 3 is a combined three-dimensional schematic diagram of Embodiment 1 of the handheld fan according to the invention.

As shown in FIGS. 1, 2, and 3, a handheld fan, comprising an air supply part and a handheld part, wherein the air supply part comprises a fan housing 1 and a fan assembly 2 arranged in the fan housing 1; the fan housing 1 comprises a cover body 101, an air outlet accessory 102 arranged at a front end of the cover body 101, a rear air inlet accessory 103 arranged at a rear end of the cover body 101, and side air inlet accessories 104 arranged at both sides of the cover body 101; the fan assembly 2 is mounted in the cover body 101, and its air outlet is connected to the air outlet accessory 102;

the handheld part comprises a handheld housing 3 and a battery 4 arranged in the handheld housing 3 and used to supply power to the fan assembly 2; the handheld housing 3 comprises a front housing body 301 and a rear housing body 302 which are buckled into each other; a top end of the front housing body 301 is connected to the cover body 101 as a whole, and an inner cavity formed by the front housing body 301 and the rear housing body 302 is connected to the cover body 101.

Preferably, the air outlet accessory 102 is provided with a plurality of air outlet guide plates 105 corresponding to the air outlet of the fan assembly 2;

the air outlet accessory 102 and the rear air inlet accessory 103 are both connected to the cover body 101 via buckles 5 and clamping slots 6;

an end of the rear air inlet accessory 103 away from the cover body 101 is provided with a curved panel 106 for guiding air flow, and an air inlet gap 107 is provided around the curved panel 106;

side air inlets 108 are provided on both sides of the cover body 101; the side air inlets 108 are connected to a mounting plate 110 via a plurality of evenly distributed connecting rods 109, and the mounting plate 110 is connected to a side air inlet accessory 104 via inserting slots 7 and inserting holes 8; a side of the side air inlet accessory 104 away from the cover body 101 is arranged in the form of a guide curved surface;

a limiting plate 9 for placing the fan assembly 2 is provided on an inner side of the rear air inlet accessory 103 and an inner side of the cover body 101;

the front housing body 301 and the rear housing body 302 of the handheld housing 3 are butt-jointed via a clamping plate 11 with a clamping hole 12 and a clamping block 10.

Preferably, it is further provided with a control system, which comprises a control main board 13 arranged inside the handheld housing 3 and above the battery 4; the control main board 13 is electrically connected to a control switch key 14 and a charging connector 15 for charging the battery 4; the handheld housing 3 is provided with a clearance hole 303 for the control switch key 14 and the charging connector 15; the fan assembly 2 is electrically connected to the battery 4 and the control main board 13.

Preferably, a bottom end of the front housing body 301 is provided with a bottom plate 304, and an upper side of the bottom plate 304 is provided with a guide plate 305; a bottom end of the rear housing body 302 is provided with a guide rod 306, and the guide rod 306 is inserted into the front housing body 301 along the guide plate 305; the bottom plate 304 and the guide rod 306 are fixedly connected via screws.

EMBODIMENT 2

Figure 4:
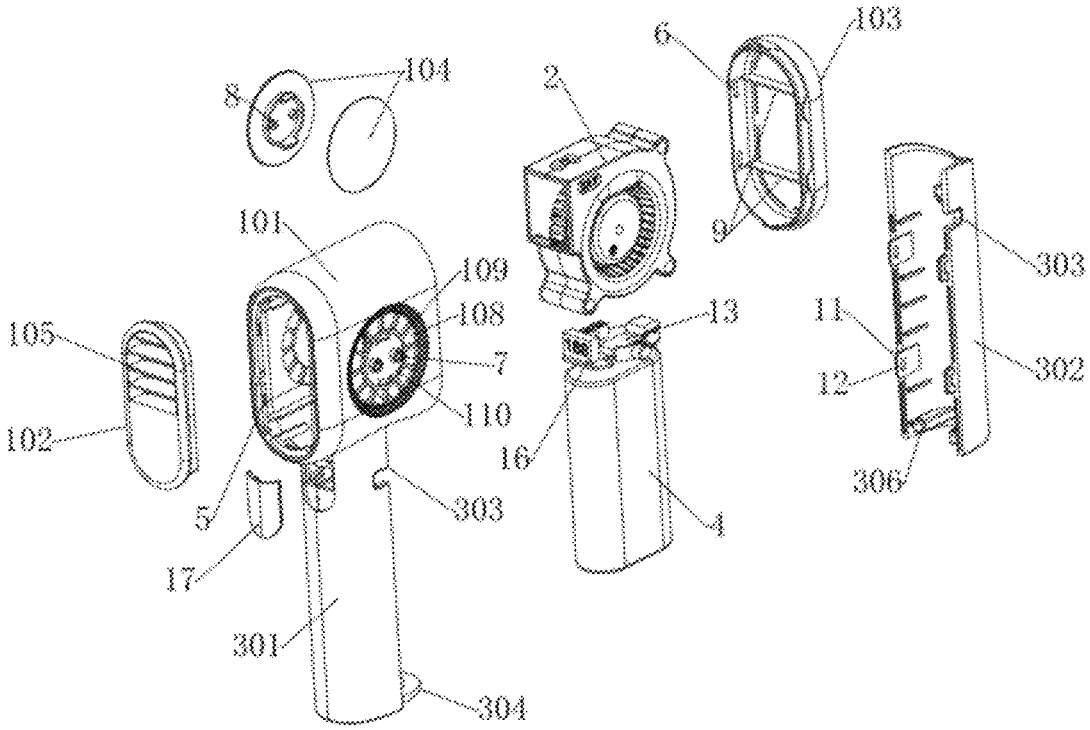
FIG. 4 is an exploded perspective view of Embodiment 2 of the handheld fan according to the invention.
Figure 5:
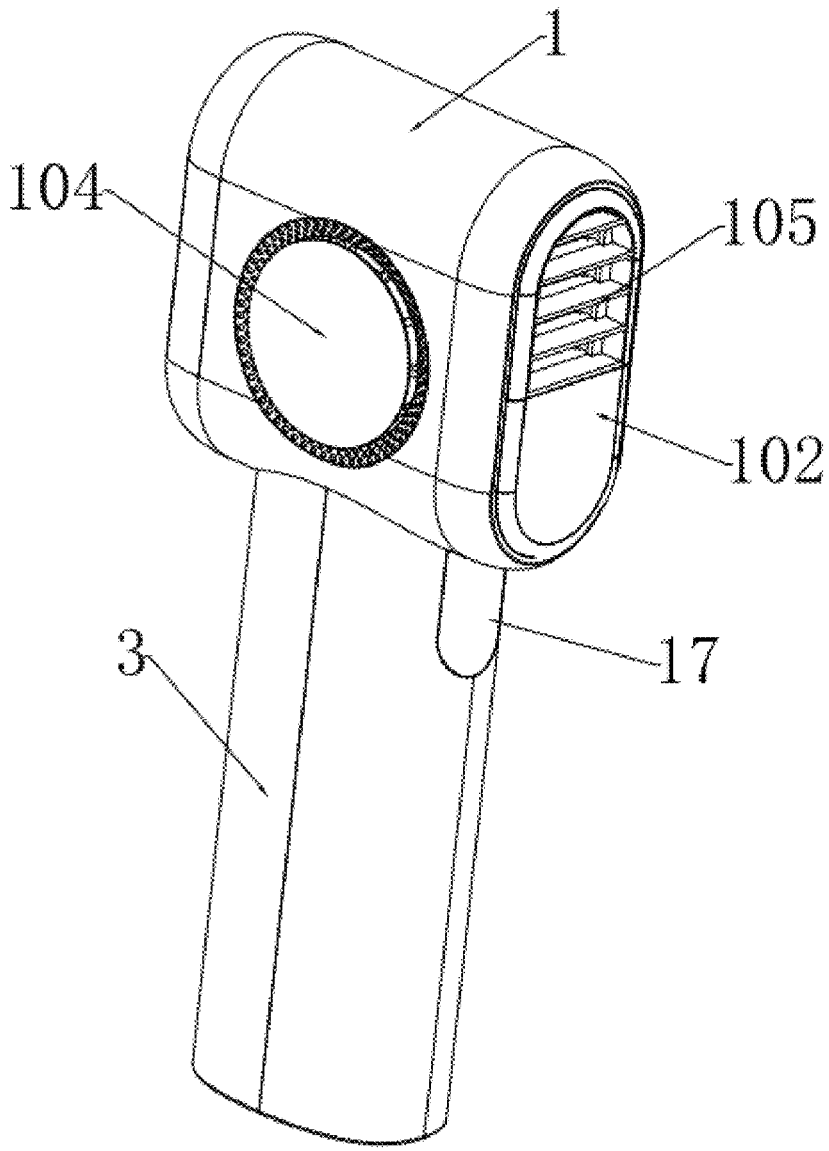
FIG. 5 is a combined three-dimensional schematic diagram of Embodiment 2 of the handheld fan according to the invention.

As shown in FIGS. 4 and 5, on the basis of Embodiment 1, the control main board is further connected to a display 16, the display 16 is mounted at a top of the front housing body 301 and is provided with a transparent protective shell 17.

EMBODIMENT 3

Figure 6:
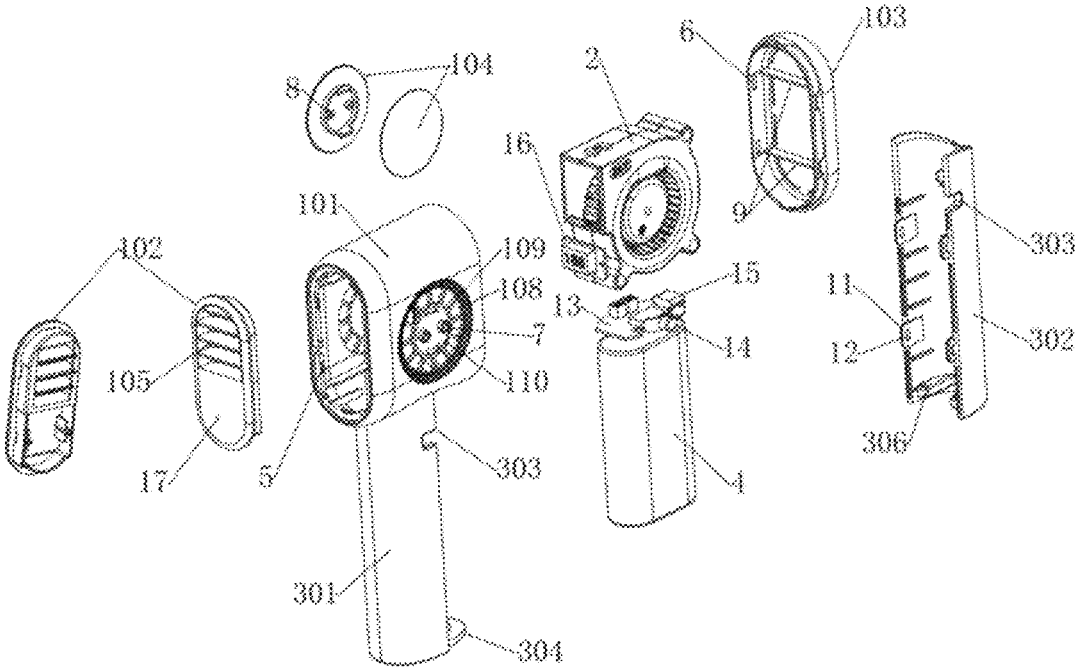
FIG. 6 is an exploded perspective view of Embodiment 3 of the handheld fan according to the invention.
Figure 7:
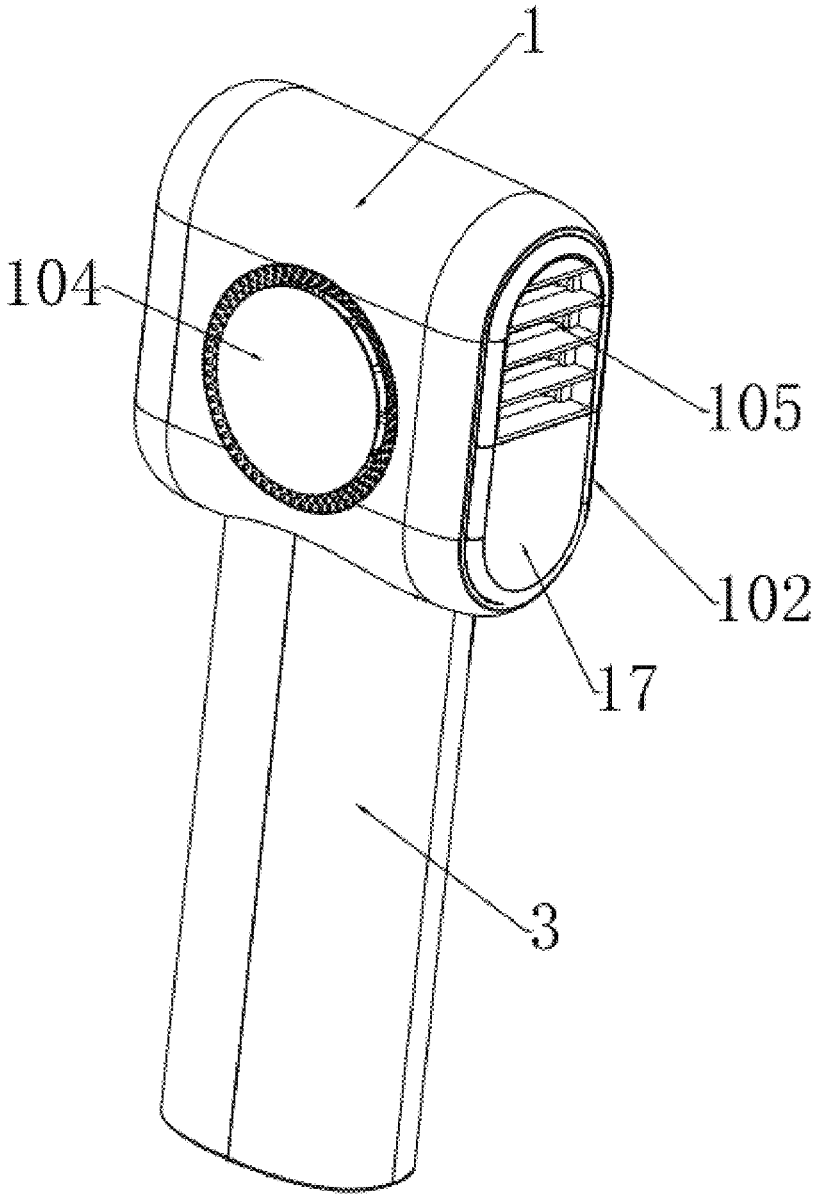
FIG. 7 is a combined three-dimensional schematic diagram of Embodiment 3 of the handheld fan according to the invention.

As shown in FIGS. 6 and 7, on the basis of Embodiment 1, the control main board is further connected to a display 16, the display 16 is mounted on the air outlet accessory 102 and is provided with a transparent protective shell 17.

Figure 8:
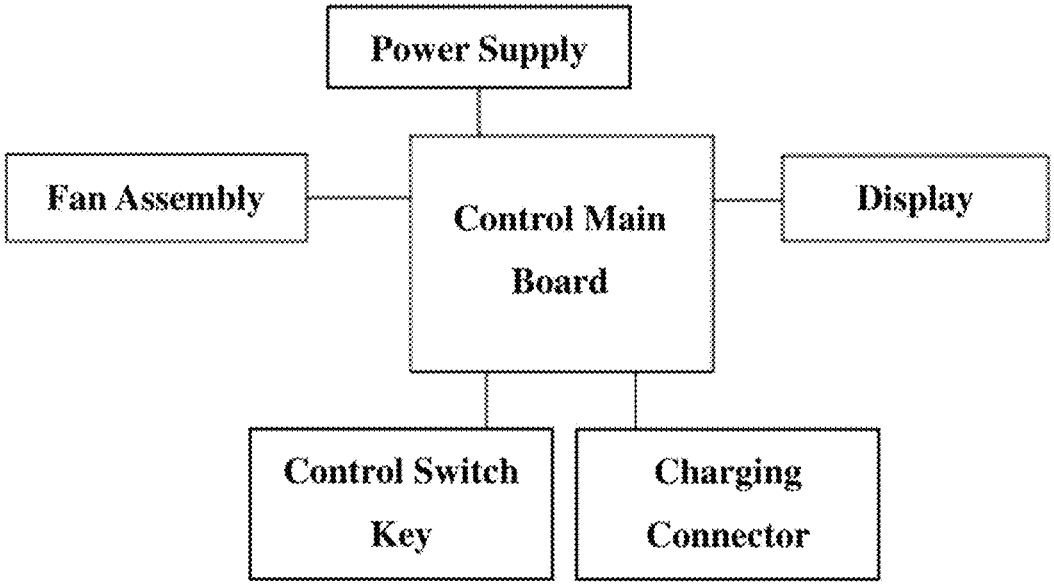
FIG. 8 is a control block diagram of Embodiments 2 and 3 according to the invention.

As shown in FIG. 8, it shows the control block diagram of the handheld fan in Embodiment 2 and Embodiment 3; the control block diagram of Embodiment 1 is shown without the display in FIG. 8.

EMBODIMENT 4

On the basis of Embodiment 1, or 2, or 3, the air outlet accessory 102 and the cover body 101 can be connected as one body.

When the invention is in use, the user holds the handheld part and operates the control switch key 14 to control the operation of the fan assembly 2. When the fan assembly 2 is working, air is taken in through the air inlet gap 107 at the rear air inlet accessory 103 and the side air inlets 108 at the side air inlet accessories 104, and then blown out from the air outlet guide plates 105 of the air outlet accessory 102. The air inlet end comprises three air inlets on the two sides and the rear end, which ensure the air intake volume of the fan and the working stability of the fan. The air outlet accessory 102 is provided with air outlet guide plates 105 which effectively assists the air outlet diversion and improves the user's air outlet experience.

The structural design of the invention is conducive to improving the compactness of the structure, while ensuring the stability and reliability during operation, thereby achieving the technical effect of improving compactness and reliability.

The contents not described in detail in this specification belong to the prior art known to those skilled in the art, for example, the fan assembly and battery in this case are prior art.

By those skilled in the art, all electrical components in this case are connected to their corresponding power supplies through wires, and a suitable controller should be selected according to actual conditions to meet control requirements. The specific connection and control sequence should refer to the working principle, and the electrical connection between the electrical components is completed in the order of working. The detailed connection means are well-known technologies in the field and will not be explained in the electrical control.

The invention and the embodiments thereof are described hereinabove, and this description is not restrictive. What is shown in the drawings is only one of the embodiments of the invention, and the actual structure is not limited thereto. All in all, structural methods and embodiments similar to the technical solution without deviating from the purpose of the invention made by those of ordinary skill in the art without creative design shall all fall within the protection scope of the invention.

The invention claimed is:

1. A handheld fan, comprising an air supply part and a handheld part, wherein the air supply part comprises a fan housing and a fan assembly arranged in the fan housing; the fan housing comprises a cover body, an air outlet accessory arranged at a front end of the cover body, a rear air inlet accessory arranged at a rear end of the cover body, and side air inlet accessories arranged at both sides of the cover body; the fan assembly is mounted in the cover body, and its air outlet is connected to the air outlet accessory;

the handheld part comprises a handheld housing and a battery arranged in the handheld housing and used to supply power to the fan assembly; the handheld housing comprises a front housing body and a rear housing body which are buckled into each other; a top end of the front housing body is connected to the cover body as a whole, and an inner cavity formed by the front housing body and the rear housing body is connected to the cover body.

2. The handheld fan of claim 1, wherein:

the air outlet accessory is provided with a plurality of air outlet guide plates corresponding to the air outlet of the fan assembly;

the air outlet accessory and the rear air inlet accessory are both connected to the cover body via buckles and clamping slots;

an end of the rear air inlet accessory away from the cover body is provided with a curved panel for guiding air flow, and an air inlet gap is provided around the curved panel;

side air inlets are provided on both sides of the cover body; the side air inlets are connected to a mounting plate via a plurality of evenly distributed connecting rods, and the mounting plate is connected to a side air inlet accessory via inserting slots and inserting holes; a side of the side air inlet accessory away from the cover body is arranged in the form of a guide curved surface;

a limiting plate for placing the fan assembly is provided on an inner side of the rear air inlet accessory and an inner side of the cover body;

the front housing body and the rear housing body of the handheld housing are butt-jointed via a clamping plate with a clamping hole and a clamping block.

3. The handheld fan of claim 2, wherein a bottom end of the front housing body is provided with a bottom plate, and an upper side of the bottom plate is provided with a guide plate; a bottom end of the rear housing body is provided with a guide rod, and the guide rod is inserted into the front housing body along the guide plate; the bottom plate and the guide rod are fixedly connected via screws.

4. The handheld fan of claim 1, wherein it is further provided with a control system, which comprises a control main board arranged inside the handheld housing and above the battery; the control main board is electrically connected to a control switch key and a charging connector for charging the battery; the handheld housing is provided with a clearance hole for the control switch key and the charging connector; the fan assembly is electrically connected to the battery and the control main board.

5. The handheld fan of claim 4, wherein the control main board is further connected to a display.

6. The handheld fan of claim 4, wherein the display is mounted at a top of the front housing body and is provided with a transparent protective shell.

7. The handheld fan of claim 4, wherein the display is mounted on the air outlet accessory and is provided with a transparent protective shell.

* * * * *